US009365398B2

(12) United States Patent
Benton et al.

(10) Patent No.: US 9,365,398 B2
(45) Date of Patent: Jun. 14, 2016

(54) OUTRIGGER PAD MONITORING SYSTEM

(71) Applicant: Manitowoc Crane Companies, LLC, Manitowoc, WI (US)

(72) Inventors: John F. Benton, Smithsburg, MD (US); Matthew T. Oswald, Manitowoc, WI (US); Stephen J. Schoonmaker, Chambersburg, PA (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 196 days.

(21) Appl. No.: 13/828,127

(22) Filed: Mar. 14, 2013

(65) Prior Publication Data

US 2014/0116975 A1 May 1, 2014

Related U.S. Application Data

(60) Provisional application No. 61/720,486, filed on Oct. 31, 2012.

(51) Int. Cl.

| | |
|---|---|
| ***B66C 23/88*** | (2006.01) |
| ***B66C 23/78*** | (2006.01) |
| ***B66C 23/80*** | (2006.01) |
| ***B66C 23/90*** | (2006.01) |

(52) U.S. Cl.

CPC ..... *B66C 23/88* (2013.01); *B66C 23/78* (2013.01); *B66C 23/80* (2013.01); *B66C 23/905* (2013.01)

(58) Field of Classification Search

CPC ..... B66C 23/88; B66C 23/905; B66C 23/80; B66C 23/78

See application file for complete search history.

(56) References Cited

U.S. PATENT DOCUMENTS

| | | | | |
|---|---|---|---|---|
| 4,216,868 | A * | 8/1980 | Geppert | 212/278 |
| 5,251,768 | A * | 10/1993 | Yoshimatsu et al. | 212/277 |
| 6,170,681 | B1 * | 1/2001 | Yoshimatsu | 212/278 |
| 6,283,269 | B1 * | 9/2001 | Mayer | 198/313 |
| 6,378,686 | B1 * | 4/2002 | Mayer et al. | 198/314 |
| 6,516,917 | B1 * | 2/2003 | Mayer et al. | 182/17 |
| 7,012,540 | B2 | 3/2006 | Petzold et al. | |
| 2007/0017889 | A1 * | 1/2007 | Schobesberger | 212/308 |
| 2007/0090612 | A1 * | 4/2007 | Gelies | 280/6.153 |
| 2007/0289931 | A1 * | 12/2007 | Henriksson | 212/274 |

(Continued)

FOREIGN PATENT DOCUMENTS

| | | |
|---|---|---|
| DE | 101 101 76 A | 9/2002 |
| EP | 2 573 039 A2 | 3/2013 |

OTHER PUBLICATIONS

European Search Report for related European Application No. 13189867.8, dated Feb. 18, 2014 (7 pages).

(Continued)

*Primary Examiner* — Mussa A Shaawat

(74) *Attorney, Agent, or Firm* — Brinks Gilson & Lione; John C. Bacoch

(57) ABSTRACT

An outrigger pad monitoring system for determining crane stability includes a plurality of outriggers having sensors for measuring a load placed on the outriggers. A crane control system utilizes the measured load on the outriggers to determine the stability of the crane. A crane control system utilizes the measured load on the outriggers with positional information for the crane boom to determine if the crane boom is in a side-load condition. The outrigger pad monitoring system may be used during the setup of the crane and to verify the proper operation of a rated capacity limiter.

26 Claims, 7 Drawing Sheets

(56) References Cited

U.S. PATENT DOCUMENTS

| | | | | |
|---|---|---|---|---|
| 2010/0135758 | A1* | 6/2010 | Gallione et al. | 414/505 |
| 2011/0062695 | A1* | 3/2011 | Bergemann et al. | 280/763.1 |
| 2011/0181457 | A1* | 7/2011 | Basten | G01B 7/042 342/70 |
| 2011/0278252 | A1* | 11/2011 | De Carvalho Cal et al. | 212/279 |
| 2012/0160796 | A1* | 6/2012 | Weckbecker et al. | 212/284 |
| 2012/0279938 | A1* | 11/2012 | Benton et al. | 212/277 |
| 2012/0312767 | A1* | 12/2012 | Bohnacker et al. | 212/276 |
| 2013/0066527 | A1* | 3/2013 | Mizuochi et al. | 701/50 |
| 2013/0079974 | A1* | 3/2013 | Stake | 701/32.9 |

OTHER PUBLICATIONS

Office Action for related European Application No. 13189867.8, dated Jan. 12, 2015 (4 pages).

* cited by examiner

OUTRIGGER PAD MONITORING SYSTEM

REFERENCE TO EARLIER FILED APPLICATION

The present application claims the benefit of the filing date under 35 U.S.C. §119(e) of Provisional U.S. Patent Application Ser. No. 61/720,486, filed Oct. 31, 2012, which is hereby incorporated by reference in its entirety.

FIELD

Embodiments of the invention generally relate to cranes and more particularly to crane safety systems.

BACKGROUND

Mobile cranes typically include a carrier unit in the form of a transport chassis and a superstructure unit having an extendable boom. The superstructure unit is typically rotatable upon the carrier unit. In transport the crane is supported by the carrier unit on its axles and tires.

At times, the crane needs to be stabilized beyond what can be provided while resting on the tires and axles of the transport chassis. In order to provide stability and support of the crane during lifting operations, it is well known to provide the carrier unit with an outrigger system. An outrigger system will normally include at least two (often four or more) telescoping outrigger beams with outrigger jacks and outrigger pads for supporting the crane when the crane is located in a position at which it will perform lifting tasks.

Utilizing the telescoping outrigger beams, the outrigger pads may be positioned at locations at which they will provide a stabilizing base for the crane. The outrigger jacks are then extended, lowering the outrigger pads into contact with the ground in order to support and stabilize the carrier unit and the superstructure unit. The outrigger jacks may be extended sufficiently, if desired, so as to support the crane in a manner such that the tires are elevated above the ground.

Historically, a crane operator would determine the degree to which the telescoping outrigger beams should be extended to properly stabilize a crane, and visually inspect to determine if the outrigger pads were lowered to a degree such that they were supporting and stabilizing the crane. It is useful, however, to be able to verify that the outrigger pads are actually supporting the crane and to provide an indication to the operator of that status. It would also be beneficial to be able to monitor the loads placed on the outrigger pads and to then provide appropriate signals of those loads to a crane monitoring and control system. Furthermore, it would be useful to be able to use the appropriate signals of those load conditions to determine the stability of the crane.

SUMMARY

Embodiments include a crane having an outrigger pad monitoring system. The crane includes a crane body, a plurality of outrigger assemblies attached to the crane body, and a crane control system. Each of the plurality of outrigger assemblies includes an outrigger body coupled to the crane body, an outrigger jack coupled to the outrigger body and configured to selectively extend and retract relative to the outrigger body, an outrigger pad coupled to the outrigger jack, and a sensor adapted to measure a property from which a reaction force on the outrigger pad can be determined. The crane control system is communicatively coupled to each of the sensors of the plurality of outrigger assemblies. The crane control system includes a processor, a user input device, and a computer readable storage memory having instructions stored thereon, that, when executed by the processor, cause the crane control system to perform a setup function. The setup function includes receiving a user input through the user input device, causing a first outrigger jack to extend relative to the outrigger body, receiving from a first of the sensors a signal from which a first reaction force acting on a first of the outrigger pads can be determined, and determining a first outrigger pad status for the first outrigger pad.

In another embodiment a crane includes a crane body, a crane boom attached to the crane body, a plurality of outrigger assemblies attached to the crane body, and a crane control system. Each of the plurality of outrigger assemblies includes an outrigger body coupled to the crane body, an outrigger jack coupled to the outrigger body and configured to selectively extend and retract relative to the outrigger body, an outrigger pad coupled to the outrigger jack, and a sensor adapted to measure a property from which a measured reaction force on the outrigger pad can be determined. The crane control system is communicatively coupled to each of the sensors and includes a processor and a computer readable storage memory having instructions stored thereon, that, when executed by the processor, cause the crane control system to perform a plurality of functions. The functions include computing a theoretical reaction force for each outrigger pad, receiving from each sensor a representation of a measurement of a reaction force at each outrigger pad, comparing the theoretical reaction force for each outrigger pad to the measured reaction force at each outrigger pad, and determine the stability of the crane based on the comparison of the theoretical reaction forces and the measured reaction forces.

In another embodiment a crane includes a crane body, a crane boom attached to the crane body, a plurality of outrigger assemblies attached to the crane body, and a crane control system. Each of the plurality of outrigger assemblies includes an outrigger body coupled to the crane body, an outrigger jack coupled to the outrigger body and configured to selectively extend and retract relative to the outrigger body, an outrigger pad coupled to the outrigger jack, and a sensor adapted to measure a property from which a measured reaction force on the outrigger pad can be determined. The crane control system is communicatively coupled to each of the sensors and includes a processor and a computer readable storage memory having instructions stored thereon, that, when executed by the processor, cause the crane control system to perform a plurality of functions. The functions include receiving from each sensor a signal from which the measured reaction force at each outrigger pad can be determined, determining a position of each of the outrigger pads, computing a first center of mass based on the measured reaction force at and position of each outrigger pad, determining a position of the crane boom, determining a crane load on the crane boom, computing a second center of mass based on the position of the crane boom and the crane load, comparing the first center of mass to the second center of mass, and determining the stability of the crane based on the comparison of the first center of mass to the second center of mass.

In another embodiment a crane outrigger pad strain monitoring system includes a strain gauge, a data processor, and a sensor. The strain gauge is adapted to determine a strain within the crane outrigger pad and output a strain signal representative of the strain. The data processor is operably coupled to the strain gauge and adapted to receive the strain signal. The sensor is operably coupled to the data processor and adapted to identify an outrigger pad associated with the crane outrigger pad strain monitoring system.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which.

The drawings are not necessarily to scale.

DETAILED DESCRIPTION

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Detailed Description does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

Figure 1:
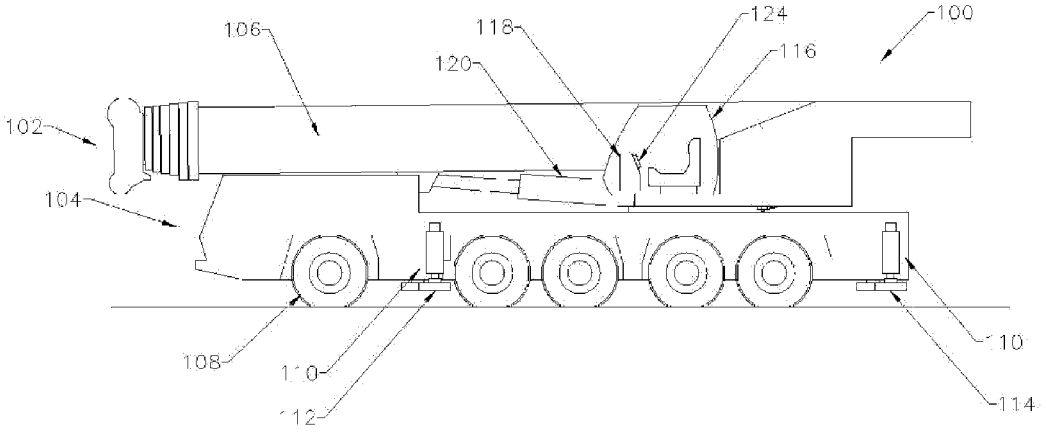
FIG. 1 is an orthogonal view of an embodiment of a mobile crane.

Referring to FIG. 1, an exemplary mobile crane 100 comprises a superstructure unit 102 disposed on a transportable chassis or carrier unit 104. The superstructure unit 102 may include any of a variety of types of extendable booms (e.g., telescopic boom 106). The carrier unit 104 is provided with tires 108 that enable the mobile crane 100 to maneuver over land to a desired location for lifting tasks. In some embodiment the carrier unit 104 may be fitted with other components for maneuvering the crane, such as crawler tracks.

The superstructure unit 102 may include a cab 116 from which an operator may control the function of the mobile crane 100. A crane control system 118 comprising a computer processor, computer readable storage memory, a user interface, and a communications interface may be located in the cab 116 or proximate the cab 116. In some embodiments, components of the crane control system 118 may be distributed in different sections of the mobile crane 100. The computer readable storage memory is operably coupled to the computer processor such that it is able to communicate with the computer processor. The computer readable storage memory stores instructions that, when executed by the computer processor, cause the computer processor to implement functions. The computer readable storage media may also store information related to the operation of the mobile crane 100. The user interface is operably coupled to the computer processor such that an operator is able to interact with computer processor. For example, through the user interface the operator may obtain information related to the mobile crane 100 operation and cause the computer processor to implement a function.

Often when lifting loads, support is needed beyond what can be provided by the tires 108. Therefore, once the carrier unit 104 positions the mobile crane 100 at a location to perform lifting tasks, an outrigger system 110 is provided for stabilizing the mobile crane 100 during lifting operations. The outrigger system 110 is most often provided as part of the carrier unit 104. In the example illustrated in FIG. 1, the outrigger system 110 comprises a set of front outriggers 112 and a set of rear outriggers 114.

Figure 2A:
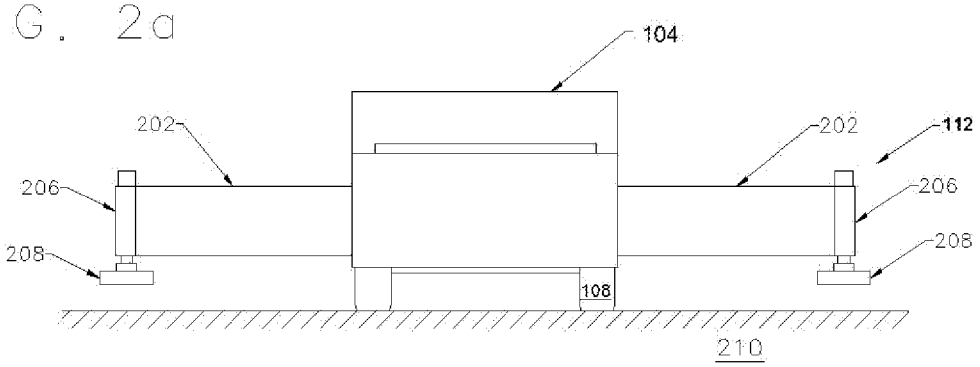
FIG. 2*a* is a schematic drawing of an outrigger system illustrating the outrigger jacks in an up position and the crane wheels supporting the chassis.
Figure 2B:
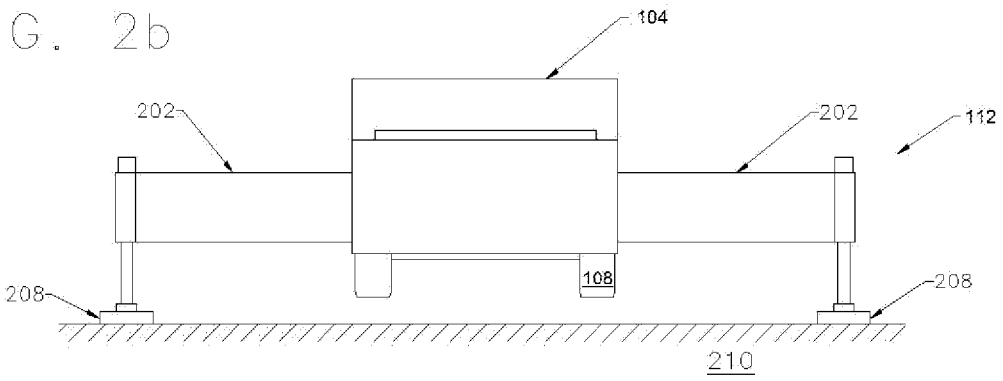
FIG. 2*b* is a schematic drawing of the outrigger system illustrating the outrigger jacks in an extended position with the outrigger jacks supporting the chassis.

FIGS. 2*a* and 2*b* illustrate a schematic diagram of the set of front outriggers 112 viewed perpendicularly to an axis of outrigger beams 202. In this schematic, the superstructure unit 102 is not shown for clarity. The outrigger beams 202 are shown extended away from the carrier unit 104. The outrigger beams 202 have outrigger jacks 206 disposed at an outer end of the outrigger beam 202. An operator may interact with the crane control system 118 through the user interface to implement a function to cause the outrigger jacks 206 to extend and lift the carrier unit 104, as shown in FIG. 2*b*. The outrigger jacks 206 have an outrigger pad 208 disposed at a lower end of the outrigger jack 206. The outrigger pad 208 provides an interface between a base surface 210 and the outrigger jacks 206. The outrigger pad 208 may be physically connected the outrigger jack 206, or in some embodiments, the outrigger pad 208 may be unconnected and interact with the outrigger jack 206 through the outrigger pad 208 supporting the weight of the crane 100 through the outrigger jack 206. In either situation, the outrigger pad 208 considered to be coupled to the outrigger jack 206.

In FIG. 2*a*, the carrier unit 104 is supported by tires 108. In normal transport mode, the carrier unit 104 is supported by the tires 108. During transport, the outrigger beams 202 would typically be refracted. If the mobile crane 100 were to attempt to lift a load with the configuration shown in FIG. 2*a*, with the outrigger beams 202 extended, but with the outrigger jacks 206 retracted, the lateral stability of the mobile crane 100 would be the same as if the outrigger beams 202 were not extended. No benefit is provided by the outrigger beams 202 unless the outrigger pads 208 are on the base surface 210.

In FIG. 2*b*, the outrigger jacks 206 are shown extended such that the carrier unit 104 is lifted off of the base surface 210. The outrigger pads 208 are then supporting the weight of the mobile crane 100 and any load the mobile crane 100 is lifting. The configuration in FIG. 2*b* is more stable than the configuration of FIG. 2*a*, because the effective fulcrum has been moved from the edge of the tire 108 to where the outrigger pad 208 touches the base surface 210.

During setup of the mobile crane 100, the operator first extends the outriggers beams 202 to a safe operating length by using the crane control system 118 through the user interface. In the past, the operator would then visually verify that the outrigger beam 202 was actually extended to the safe operating length. In newer mobile crane control systems 118, the outrigger beam 202 length may be sensed using a length sensor operably coupled to the computer processor or some other means for determining the length of the outrigger beam 202, such as means disclosed in PCT Application No. PCT/US2012/035477. For example, a Global Navigation Satellite System (GNSS) sensor 214, particularly one with Real Time Kinematic (RTK) capability, can be used to determine the geospatial location of the outrigger jacks, and then the relative location of the jacks between each other would be determined, and this would provide independent data for the stability footprint of the mobile crane 100.

After verifying that the outrigger beams 202 are properly extended, the operator then extends the outrigger jacks 206 thereby moving the outrigger pads 208 towards the base surface 210. The operator may extend the outrigger jacks 206 sufficient to lift the tires 108 off of the base surface 210. The computer readable storage memory may store a function that causes the outrigger jacks 206 to extend to a length necessary to level the carrier unit 104. When the mobile crane 100 is operating on a flat, level surface, the outrigger jacks 206 would typically each extend the same length to level the carrier unit 104. However, in situations where the base surface 210 is not flat or level, the outrigger jacks 206 may each extend different lengths to level the carrier unit 104. If the outrigger jacks 206 are visible to the operator, the operator may visually verify that the outrigger jacks 206 are extended and the carrier unit 104 is level.

Figure 3A:
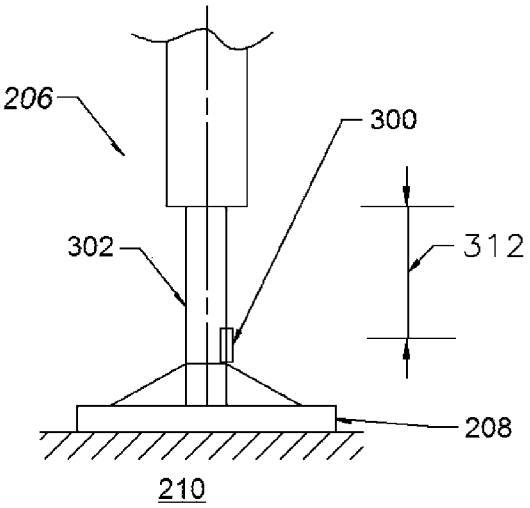
FIG. 3*a* is a detailed view of an extended outrigger with a jack in an extended position contacting a support surface.

FIG. 3*a* is a detailed view of an outrigger jack 206. In FIG. 3*a*, an outrigger jack 206 is extended such that the outrigger pad 208 is in contact with the base surface 210. A load sensor 300, such as a strain gauge, is disposed in a leg 302 of the outrigger jack 206 and is configured to measure a load in the leg 302. A strain gauge may be calibrated such that an amount of strain measured corresponds to a known load on the outrigger pad 208. Other locations for the load sensor 300 are possible and embodiments are not limited to the leg 302 of the outrigger jack 206. It is contemplated that any sensor present on the mobile crane 100 that is capable of measuring the load on the outrigger pad 208, will be compatible with embodiments of the outrigger pad monitoring system. For example, a load may be measured using a deflection of the outrigger beam 202 and the load at the pad 208 inferred dependent upon the deflection. Another example would be placing the sensor 300 on or within the outrigger pad 208 itself. In another embodiment, a strain gauge and instrumentation is placed on an attachment 314 for the bottom of the outrigger pad 208.

The load sensor 300 is operably coupled to the crane control system 118. Such operable coupling may be in the form of a wireless communication interface. A wireless communication interface is advantageous compared to a wired connection as it alleviates wiring issues associated with the moving parts of the mobile crane 100, such as the outriggers or outrigger jacks 206. Additionally, it allows the outrigger pads 208 to be easily interchanged between mobile cranes 100. Thus, the outrigger pads 208 may be shared across a fleet of mobile cranes.

Figure 5:
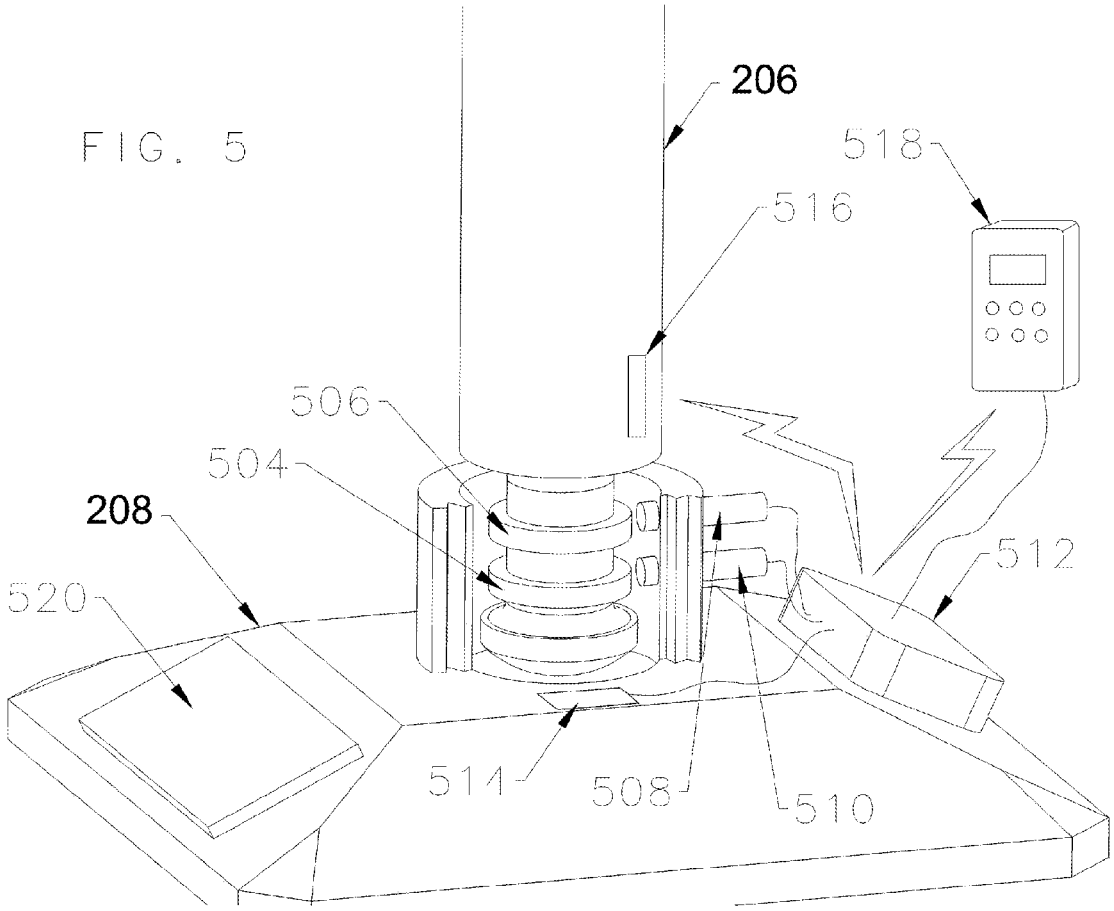
FIG. 5 is an isometric view of a portion of an outrigger assembly with an outrigger jack assembled to an outrigger pad with a cut-away of the outrigger pad to view the interior of the outrigger pad.

In embodiments in which the outrigger pads 208 are shared across a fleet of mobile cranes, it is beneficial to be able to use the outrigger pads 208 interchangeably for different outrigger locations for a given mobile crane (e.g. left versus right and front versus rear). The outrigger assembly may identify which location the outrigger assembly is sending the particular information from. This may be done wirelessly as shown the embodiment of FIG. 5. In FIG. 5, the outrigger jack 206 is provided with physical features that are unique to an outrigger assembly position. A so-called intelligent outrigger pad 208 detects these physical features to identify the outrigger assembly's position. As an exemplary embodiment, the outrigger jack 206 of FIG. 5 has machined a first machined ring 504 and a second machined ring 506. In this embodiment, the presence of the first machined ring 504 indicates the left outrigger position and the presence of second ring 506 indicates the front outrigger position. Thus the exemplary outrigger jack 206 in FIG. 5 is associated with the left front outrigger. The rings may be detected by proximity sensors, 508 and 510, built into the outrigger pad 208. The proximity sensor 508, 510 would output signals which may be detected by a wireless data processor 512. The presence or absence of the machined rings 504, 506 would indicate the four typical outrigger positions (there being four combinations of the presence or absence of the machined rings 504, 506). Additional machined rings or other features may be used to detect more complicated outrigger arrangements for outriggers beyond the typical four outriggers.

Other methods for identifying outrigger position as well as identifying a particular mobile crane 100 among multiple mobile cranes on a jobsite are possible. In one embodiment, a wireless tag (for example RFID or WiFi) device 516 is disposed on the outrigger jack 206. The wireless tag 516 could be factory-installed and/or embedded in the outrigger jacks 206. A further approach to outrigger position and particular mobile crane identification for an intelligent outrigger pad 208 would be remote programming such as via a hand-held device 518 with the means to communicate with the wireless data processor 512. This communication with the wireless data processor 512 could be accomplished via wired or wireless connection, depending on the particular jobsite environment. An operator would enter the identification data (crane unit and outrigger location on crane unit) via the user interface on the hand-held device 518. In the exemplary embodiment for the wireless communication interface, the data processor 512 would also receive outrigger pad strain gauge 514 signals, and it would have a power source attached to the outrigger pad 208 such as a solar panel 520 or an energyharvesting capability driven by motion of the outrigger jack 206 or the changing shape of the outrigger pad 208 during lifting.

Returning to FIG. 3, the load sensor 300 comprises a strain gauge that is configured to output a representation of the strain measured at the outrigger leg 302. The strain is related to the load on the outrigger leg 302 and the representation of the strain is also a representation of the load on the outrigger pad 208. The crane control system 118 communicates with the load sensor 300 over the operable coupling. The crane control system 118 may have a function for displaying a load indicated by the representation of the load at the outrigger pad 208. The function for displaying a load may display a load for each outrigger pad 208. In some embodiments, the function for displaying a load may display a load for each outrigger pad 208 sorted by load or other characteristic. The crane control system 118 may have a function for indicating an alarm if the load exceeds a predetermined level. This is useful in instances in which the mobile crane 100 may be working at a location with known maximum outrigger pad loads. For example, a base surface 210 comprising a loose soil may only be able to withstand a certain load, or a base surface 210 comprising a building structure may only be rated to withstand a certain load. If the operator performs a function that would cause the mobile crane 100 to exceed the certain load, the crane control system 118 may stop the mobile crane 100 from performing the function, sound a warning, display a visual warning, or perform a combination of the foregoing operations. Additionally, the crane control system 118 may have a function for logging the measured loads to the computer readable storage memory. The history of the mobile crane loads can then be recalled at future times.

Figure 7:
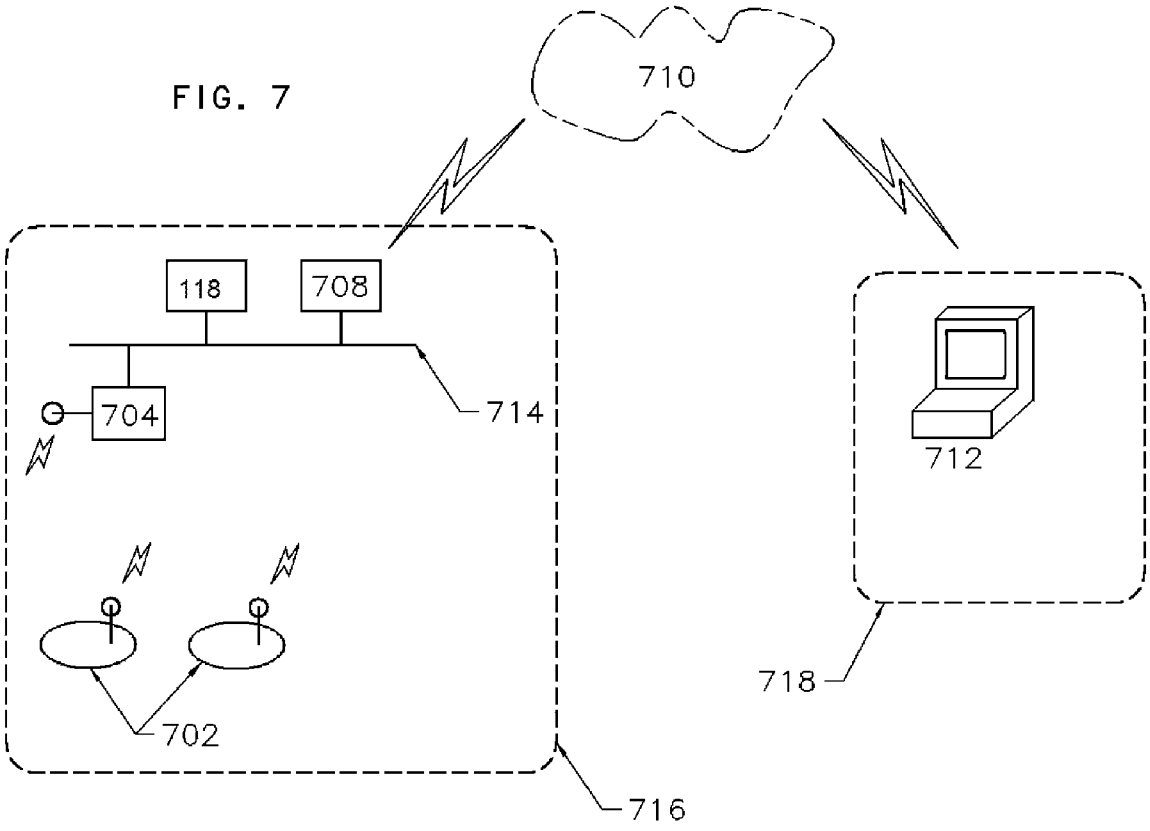
FIG. 7 is a schematic representation of an integrated electronic system on a crane using global data infrastructure.

FIG. 7 illustrates a schematic of an integrated electronics system 716 of which the crane control system 118 may be a component of. The integrated electronics system 716 includes a telematics control unit 708 performing a telematics function that allows a remote location 718 to log and analyze the behavior of the outrigger pad monitoring system. The load sensor 300 associated with each outrigger jack wirelessly transmits to a receiver 704. The receiver 704 is on a bus 714 of the integrated electronics system 716. The crane control system 706 or the receiver 704 provides data on the bus 714 which is retrieved by the telematics control unit 708. The telematics control unit 708 manages the transmission of appropriate data to a global data infrastructure 710, and a remote data system 712 receives and manages the appropriate data.

Each outrigger assembly may have its own load sensor 300 for determining the load at that particular outrigger leg 302. All of the load sensors 300 may then be operably coupled to the crane control system 118. The crane control system 118 may perform a function such as a function for determining whether the outrigger pads 208 have made contact with the base surface 210, determining whether the outrigger pads 208 are in contact with a stable base surface 210, determining whether the mobile crane 100 is set up properly, determining a stability of the mobile crane 100, verifying the operation of a mobile crane safety system, and combinations of the foregoing.

Figure 3B:
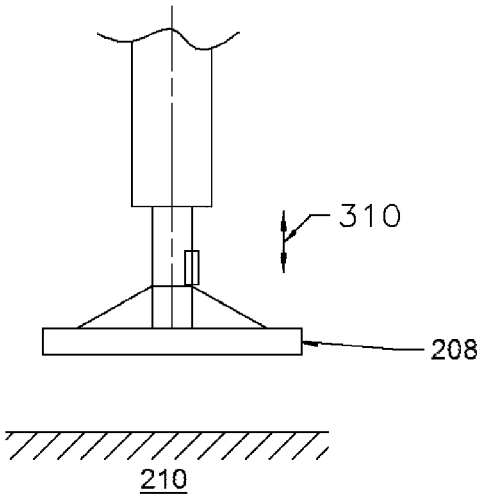
FIG. 3*b* is a detailed view of an extended outrigger with a jack in a partially extended position and an outrigger pad not in contact with a support surface.

During setup, the crane control system 118 may determine whether the outrigger pads 208 have made contact with the base surface 210 using the load sensors 300. As illustrated in FIG. 3*b*, when the outrigger pad 208 is not in contact with the base surface 210 the outrigger leg 302 is under a tension load 310. The load sensor 300 will measure a negative load reflecting the tension caused by the weight of the outrigger pad 208 pulling down on the outrigger leg 302. In some embodiments the load sensor 300 may be calibrated such that the weight of the outrigger pad 208 results in a zero load value. As the outrigger jack 206 extends downward, the outrigger pad 208 contacts the base surface as shown in FIG. 3*a* and the outrigger leg 302 experiences a compressive load 312 resulting in the load sensor 300 measuring a 210 load. It can be inferred that the outrigger pad 208 has contacted the base surface 210 when the load sensor 300 measures a positive load.

In some situations it may be possible for the outrigger jacks 206 to level the carrier unit 104, yet have an outrigger pad 208 that is on an unstable base surface 210. Embodiments of the current invention may provide an aid for detecting this condition. If the outrigger jacks 206 are extended such that the tires 108 are elevated, the sum of the loads on each outrigger pad 208 should equal the weight of the mobile crane 100. Additionally, the load on each outrigger pad 208 should have a 208 weight distribution between the outrigger pads 208. If any individual outrigger pad 208 load is substantially less than the expected value, it may be inferred that the outrigger pad 208 is not properly supporting the mobile crane 100. For example, if the mobile crane 100 is set up on a base surface 210 that fails to support one of the outrigger pad 208 loads, such as soft ground beneath an outrigger pad 208, the mobile crane 100 could be supported substantially by the remaining outrigger pads 208. In a system with four outriggers supporting a carrier unit 204 having four outrigger pads 208, three outrigger pads could each carry a portion of the total load with the fourth outrigger pad 208 carrying almost no load. The crane control system 118 may have a function that compares the expected load of each individual outrigger pad 208 and compares it to the measured load. If the measured load of a particular outrigger pad 208 is less than the expected value by a pre-determined amount, it may be inferred that the outrigger pad 208 is on an unstable base surface 210.

Even in situations where the outrigger pads 208 are all on a stable base surface 210, it is possible that when the mobile crane 100 is being set up that the outrigger jacks 206 may not be extended properly. For example, diagonal pairs of outrigger pads 208 may support the majority of the load with the remaining outrigger pads 208 only preventing the mobile crane 100 from rotating about an axis between the diagonal pairs of outrigger pads 208. In operation, such a situation may not significantly affect the load carrying capacity of the mobile crane 100, as the outrigger pad 208 will still support the mobile crane 100 as the load shifts the center of mass the gravity of the mobile crane 100. However, such a situation may cause a torque of the carrier unit 104 possibly twisting the frame. This could result in a permanent deformation of the frame of the carrier unit 104. Similar to the previously described test for determining if the outrigger pads 208 are on level ground, the crane control system 118 can compare the expected load of the outrigger pads 208 to the actual measured loads. If diagonal pairs of outrigger pads have loads outside of the expected load, the crane control system 118 may determine that the mobile crane 100 is not set up properly. In some embodiments, the sensors may monitor the loads at the outrigger pads 208 as the outrigger jacks 206 are being extended and equalize the load across the different outrigger pads 208.

The crane control system 118 may use the measured outrigger pad 208 loads to monitor the stability of the mobile crane 100 while the mobile crane 100 is in operation. This system may be used independent of, or as a backup to, a rated capacity limiter (RCL) system. FIG. 4 illustrates an example of how the measured outrigger pad 208 loads may be used to monitor the stability of the mobile crane 100. In FIG. 4, a simplified overhead schematic of the positioning of outrigger pads is shown. The present example illustrates a mobile crane 100 having four outriggers and the position of a first outrigger pad 402, a second outrigger pad 404, a third outrigger pad 406, and a fourth outrigger pad 408. The center of rotation 410 of the crane superstructure 102 is shown between the outrigger pads. The mobile crane 100 has a horizontal center of mass 412 that is dependent upon the weight distribution of the mobile crane 100, the position of the crane hook, and the load on the hook. The horizontal center of mass 412 will move as the mobile crane 100 moves the hook or attempts to lift a load. The horizontal center of mass will have a swing angle 416 with respect to the rotational axis of the superstructure unit 102 upon the carrier unit 104 that can be calculated by the outrigger pad monitoring system. The central axis of the crane boom 106 can also have a swing angle 418 with respect to the same axis that is measured by a swing angle sensor, and this angle can be compared with angle 416.

A tipping plane 414 is defined as a vertical plane passing through a line passing through adjacent outrigger pads. The tipping plane 414 is defined on each side of the mobile crane 100. When the horizontal center of mass is within the area bounded by the tipping planes 414, the mobile crane 100 is in a stable condition. As the horizontal center of mass 412 approaches one of the tipping planes 414, the load on the outrigger pads not defining the tipping plane 414 approaches zero. If the horizontal center of mass 412 moves outside of the tipping plane 412, the mobile crane 100 will tip.

Figure 4A:
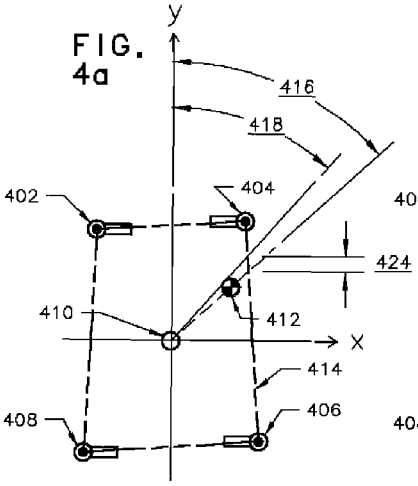
FIG. 4*a* is an overhead schematic drawing showing the position of outrigger pads relative to a crane horizontal center of mass.
Figure 4B:
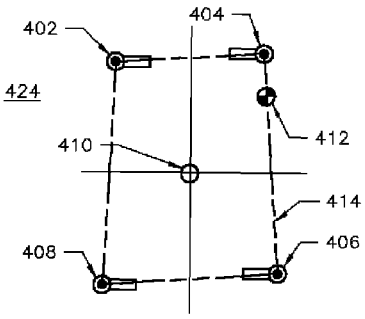
FIG. 4*b* is an overhead schematic drawing showing the position of outrigger pads relative to a crane horizontal center of mass with the horizontal center of mass approaching a tipping plane.

In FIG. 4*a*, outrigger pad 408 has zero load on it, but the mobile crane 100 is still stable. Each of the remaining outrigger pads 402, 404, 406 has a positive load on them. In FIG. 4*b*, the horizontal center of mass 412 has moved to the tipping plane 414. This could be the result of the hook lifting an additional load or the position of the hook changing. The load on the outrigger pads 402, 408 not defining the tipping plane 414 goes to zero and the mobile crane 100 is becoming unstable (e.g. tipping). The mobile crane 100 is only in danger of tipping when two pad loads approach zero. A single outrigger pad may have a zero load with the mobile crane 100 still being stable.

Figure 4C:
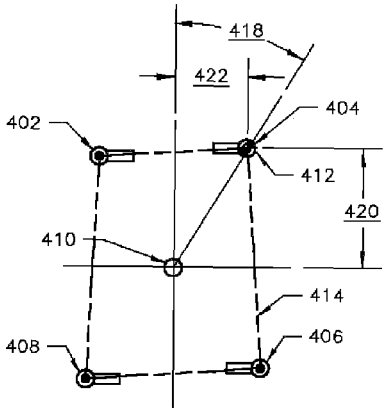
FIG. 4*c* is an overhead schematic drawing showing the position of outrigger pads relative to a crane horizontal center of mass with the horizontal center of mass being positioned over an outrigger pad.

In FIG. 4*c*, an example is shown wherein the horizontal center of mass 412 has moved directly over the top of an outrigger pad 404. In this example, the mobile crane 100 is becoming unstable (e.g. tipping), and the load at pad 406, pad 408, and pad 402 is each zero.

The crane control system 118 may have a function to determine a limit state for mobile crane 100 tipping using the outrigger pad loads. Because the mobile crane 100 remains in a stable state when only one pad measures a zero load, the limit state would not be dependent on the lowest load. Instead, the second lowest load is of the most interest to the crane control system 118. When the second to least outrigger pad load approaches zero, then the crane control system 118 may infer that the mobile crane 100 is at its limit state. The value for determining the minimum outrigger pad load may be defined as a percentage of the gross mobile crane 100 weight, the superstructure weight, or may be based on the hooks position and load.

The function for determining a limit state may function independent of any other system. For example, the limit state can be determined without regard to the position of the hook, the load on the hook, and the position of the outriggers. The function for determining a limit state therefore may be used as a solitary anti tipping mechanism, or it may be used in combination with a more traditional RCL system as a backup. Thus, during lifting operations, the RCL would provide a first means of determining the mobile crane 100 stability, but if it were to fail, the function for determining a limit state would ensure the mobile crane 100 was being operated safely.

In addition to providing a backup to a traditional RCL system, the outrigger pad monitoring system may verify the operation of the RCL system. If the RCL system were to provide information that did not correspond to the load measured at the outrigger pads, the system could notify the operator of a possible fault.

In one example of the outrigger pad monitoring system verifying the operation of the RCL system, a weight calculated by the RCL system is compared against a weight measured by the outrigger pad monitoring system. The RCL system is able to calculate a weight based on a known weight and center of weight for the mobile mobile crane 100 including the carrier and superstructure, the position and weight of any counterweights, the load on the hook, and the position of the load on the hook.

For instance, consider the following table for components of a mobile crane 100 (refer to FIG. 4*a* for x and y values in all examples):

| Component | Horizontal Position x, y in feet | Weight in tons |
|---|---|---|
| Crane | 0, 0 | 10 |
| Counterweight | 0, −5 | 5 |
| Load on Hook | 0, 10 | 5 |
| Calculated Horizontal Center of Mass | 0, 1.25 | 20 |

This result can be compared with the following measurements at the outrigger pads

| Component | Horizontal Position x, y in feet | Weight in tons |
|---|---|---|
| Pad 1 (404 in FIG. 4a) | 5, 5 | 6.25 |
| Pad 2 (402 in FIG. 4a) | −5, 5 | 6.25 |
| Pad 3 (408 in FIG. 4a) | −5, −5 | 3.75 |
| Pad 4 (406 in FIG. 4a) | 5, −5 | 3.75 |
| Calculated Horizontal Center of Mass | 0, 1.25 | 20 |

Based on the example measurements, the RCL system is expected to be configured by the operator correctly and working properly. Consider the situation where the sensor in the RCL system for determining the hook load has a fault, or the crane is in a configuration where this sensor has diminished accuracy. In this case, the total weight measured at the outrigger pads could differ substantially from the RCL measurements, and this condition could be alerted to the operator, even without outrigger beam 202 length monitoring. Consider the situation where the counterweight is not present. In this case, the total weight measured at the outrigger pads (15 tons in the example above when the counterweight is not present) would differ substantially from the RCL (20 tons in the example above), and this condition could be alerted to the operator, even without outrigger beam 202 length monitoring.

Now consider the situation where the counterweight is present, but it is resting on the carrier unit 104 and not installed on the superstructure unit 102 (as is assumed by the RCL system when the counterweight is present). In this case, the weights between the RCL and the outrigger pad monitoring system would typically be in agreement (both 20 tons in the earlier example). But, once the superstructure unit 102 is rotated with respect to the carrier unit 104, the horizontal center of mass calculated by the RCL (which has been incorrectly configured) would no longer be in agreement with the horizontal center of mass calculated from measurements of the outrigger pad monitoring system. The following chart shows the calculations for the RCL when the superstructure unit 102 is rotated to an angle such as 418 in FIG. 4*a* (the RCL assumes that the counterweight has rotated, but in fact, it has not since it is still resting on the carrier unit at x,y location 0,−5):

| Component | Horizontal Position x, y in feet | Weight in tons |
|---|---|---|
| Crane | 0, 0 | 10 |
| Counterweight (RCL incorrect assumption) | −3.535, −3.535 | 5 |
| Load on Hook | 10, 10 | 5 |
| Calculated Horizontal Center of Mass | 1.62, 1.62 | 20 |

The following chart shows the weights measured at the pads for the actual physical configuration (where the counterweight is on the carrier unit 104 at x,y location of 0,−5), as well as the center of mass calculated value:

| Component | Horizontal Position x, y in feet | Weight in tons |
|---|---|---|
| Pad 1 (404 in FIG. 4a) | 5, 5 | 10 |
| Pad 2 (402 in FIG. 4a) | −5, 5 | 2.5 |
| Pad 3 (408 in FIG. 4a) | −5, −5 | 2.5 |
| Pad 4 (406 in FIG. 4a) | 5, −5 | 5 |
| Calculated Horizontal Center of Mass | 2.5, 1.25 | 20 |

Based on these measurements, the center of mass calculated using the outrigger pad loads is different than the center of mass predicted by the RCL system. The RCL system is not operating or configured properly. The operator would then be notified of the fault and upon a visual inspection would recognize that the counterweight configuration did not match the counterweight configuration used by the RCL system.

In other embodiments the RCL system may be verified by determining the horizontal center of mass as indicated by the hook position and the load on the hook. A theoretical load can then be calculated for each of the outrigger jacks based on the center of mass and the position of the pads. This theoretical load can then be compared to a load measured at each jack. If the theoretical load is outside of an acceptable range compared to the measured load, the RCL system may be determined to be operating improperly. The actual comparison does not need to be a comparison of the actual values of the theoretical load and measured load, but may instead be a comparison of values that are dependent upon the loads. For example, in some embodiments a value may be compared before a conversion of that value into the load.

Embodiments of the current invention may indicate the actual outrigger beam 202 extension distance 422 (in FIG. 4*c*), without a length sensor for this assembly. If the swing angle 418 (in FIG. 4*c*) for the crane boom is known by a sensor, and the crane boom is rotated to have the horizontal center of mass in line with the location of a particular outrigger pad (such as outrigger pad 404 in FIG. 4*c*), then the outrigger beam extension distance 422 is be computed as follows:

$$l = L\tan(\theta)$$

where:

l=outrigger beam extension distance 422

L=longitudinal distance 420 from superstructure rotation axis 410 to outrigger beam assembly (which is a fixed value based on manufacturing for a particular crane).

θ=crane boom swing angle 418

The appropriate crane boom swing angle 418 for each outrigger pad to perform this calculation may be determined by using a standardized configuration or motion of the mobile crane 100 (such as fixing the counterweight and crane boom position with respect to the superstructure unit 102) and then swinging the superstructure unit 102 through an entire revolution upon the carrier unit 104. With this standardized configuration selected to produce a horizontal center of mass that is not coincident with the rotational axis 410, the outrigger pad load should reach a maximum value as the crane boom is swung directly over the particular outrigger pad, and this swing angle at this position may be used as the value to calculate the outrigger beam extension distance 422. This standardized configuration and motion could produce a limit state for the RCL where monitoring and recording within the RCL would determine if the standardized configuration and motion has been performed each time the RCL is activated. Until the RCL determines this maneuver has been performed, the operation of the mobile crane 100 may be limited or prevented.

Embodiments of the invention may include another standardized maneuver to provide a limit state for the RCL. The control system may produce a pulse of pressure at the outrigger jack 206 hydraulic cylinders of each of the outrigger jacks (individually or simultaneously). The outrigger pad monitoring system may discern from the sensor 300 signal whether the outrigger pad is in contact with the base surface 210 due to the differences in the characteristics of the pulse with an outrigger pad 208 in contact with a base surface 210 compared to the characteristics of the pulse with an outrigger pad 208 not in contact with the base surface 210, and thus determine if the outrigger jacks 206 had been deployed as required for the lifting operation.

Embodiments of the invention may also indicate a side-load condition. A plane can be established that includes the superstructure unit axis of rotation 410 as well as including the central axis of a straight crane boom with no side-to-side deflection. In the side-load condition, the load on the hook is not within this plane or the crane boom is deflected from side-to-side. This condition can arise when the mobile crane 100 is lifting a load that is on the ground but offset laterally from the crane boom (such as "dragging" a load), or this condition can arise when the hook load or crane boom is experiencing extraneous forces besides the normal forces of lifting. Crane booms are typically not designed to withstand significant side-loads, and this condition is to be avoided. As indicated in FIG. 4*a*, the outrigger pad monitoring would calculate the horizontal center of mass 412 based on the reaction forces at the outrigger pads, and this would produce a calculated swing angle 416. In the side-load condition, the calculated swing angle 416 would not agree with a measured physical swing angle 418 for the crane boom. The side-load condition not only has detrimental effects on the physical crane boom, but it also alters the determinations of the distance from the center of mass 412 to the tipping plane 414. In FIG. 4*a*, one change in distance in the longitudinal direction 424 (along the tipping plane direction) is indicated.

The current invention could indicate a backwards stability condition that would not be detected by the RCL system. The RCL system typically senses hydraulic pressure in the hydraulic cylinder 120 (FIG. 1) that lifts the boom 106. The pressure is calibrated to provide an indication of the load on the hook. However, when this hydraulic cylinder 120 is extended to its maximum physical extension, the pressure values may not calibrate correctly to the load on the hook since the hydraulic pressure is exerted on the piston, but it is no longer able to extend. The outrigger pad monitoring system could detect this backwards stability condition based on the measured values of the reaction forces at the outrigger pads.

Other examples of when the RCL system and the outrigger pad monitoring system would return different values would include if a position sensor for the boom was malfunctioning, if the rotary position sensor of the superstructure were malfunctioning, the mobile crane 100 were encountering high winds, if a pad was not on a solid surface, and other potential errors.

Figure 6A:
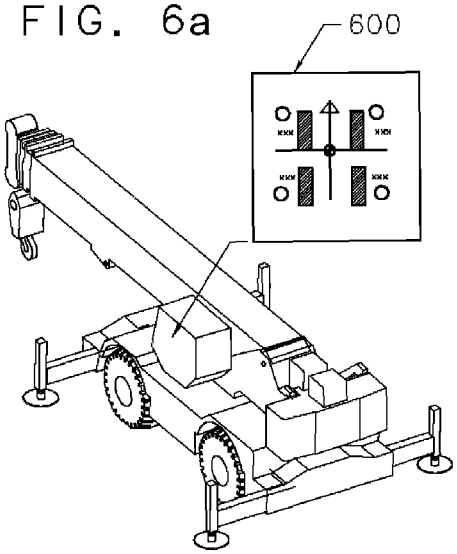
FIG. 6*a* is an isometric view of a crane with the crane boom positioned forward and a schematic drawing of a computer display screen.
Figure 6B:
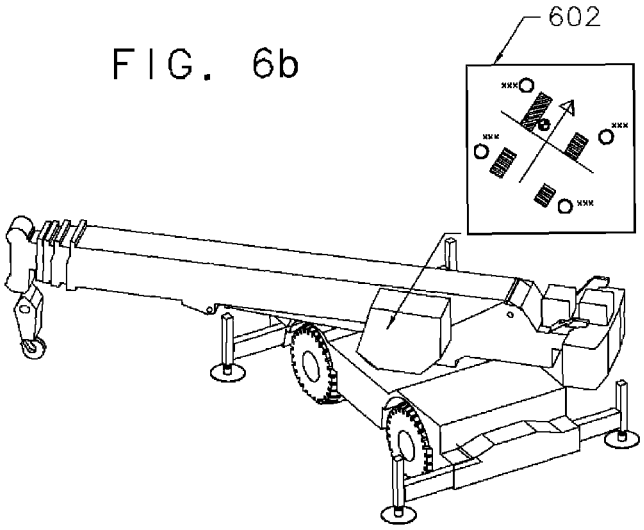
FIG. 6*b* is an isometric view of a crane with the crane boom rotated away from the forward orientation and a schematic drawing of a computer display screen reflecting this rotation.

The exemplary embodiment would include a computer display 124 in the cab 116 of the superstructure unit 102. The computer display would provide visual feedback to the mobile crane 100 operator. This would include views of the outrigger arrangement and the reaction force data from the outrigger pad. FIG. 6*a* shows the cab display view 600 with the crane boom aligned with the front of the carrier unit. As the superstructure unit rotates the visual feedback can indicate the new orientation of the outrigger pads as well as the new reaction forces. As the mobile crane 100 operator rotates with the superstructure unit, and front and rear become reversed from the point of view of the operator, it may be difficult for the mobile crane 100 operator to quickly understand the pad load data feedback. In order to assist the mobile crane 100 operator to orient his understanding of the forces based on the current superstructure location, the swing angle from the swing angle sensor may be used to re-orient the display 602 to coincide with the operator's position over the carrier unit 104. This particular view would be enhanced with a three-dimensional orthographic projection of the carrier unit to further assist the operator in understanding the current orientation of the superstructure unit and the reaction force information.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A crane having an outrigger pad monitoring system, the crane comprising:

a) a crane body;

b) a plurality of outrigger assemblies attached to the crane body, each of the plurality of outrigger assemblies comprising:

i) an outrigger body coupled to the crane body;

ii) an outrigger jack coupled to the outrigger body and configured to selectively extend and retract relative to the outrigger body;

iii) an outrigger pad coupled to the outrigger jack; and iv) a sensor adapted to measure a reaction force on the outrigger pad caused by an interaction between a base surface and the outrigger pad; and c) a crane control system communicatively coupled to each sensor of the plurality of outrigger assemblies, the crane control system comprising:

i) a processor;

ii) a user input device; and iii) a non-transitory computer readable storage memory having instructions stored thereon, that, when executed by the processor, cause the crane control system to perform a setup function including:

A) receive a user input through the user input device;

B) cause a first outrigger jack to extend towards the base surface;

C) receive from a first of said sensors a signal representative of a first reaction force acting on a first of said outrigger pads; and D) determine a first outrigger pad status for the first outrigger pad based on the first reaction force.

2. The crane of claim 1 wherein determining a first outrigger pad status comprises comparing the first reaction force to a stored value.

3. The crane of claim 2 wherein the stored value is a fraction of a crane weight.

4. The crane of claim 1 wherein the setup function further includes:

a) causing each outrigger jack to extend towards the base surface;

b) receiving from each sensor a representation of each reaction force acting on each outrigger pad;

c) determining each outrigger pad status for each of the outrigger pads.

5. The crane of claim 4 wherein the setup function further includes calculating a total reaction force and comparing each reaction force for each outrigger pad to at least a portion of the total reaction force.

6. The crane of claim 4 wherein the plurality of outrigger assemblies includes four outrigger assemblies.

7. The crane of claim 1 wherein the outrigger pad status is selected from the group consisting of a) on solid ground, b) in air, and c) on unstable ground.

8. The crane of claim 1 wherein the crane control system is communicatively coupled to at least one of the sensors through a wireless connection.

9. The crane outrigger pad monitoring system of claim 8, further comprising a telematics unit operably coupled to the crane control system, the telematics unit adapted to communicate with a remote system.

10. The crane outrigger pad monitoring system of claim 9, further comprising a remote system, the remote system adapted to operably couple with the telematics unit through a global data infrastructure.

11. The crane outrigger pad monitoring system of claim 10, wherein the global data infrastructure is selected from the group consisting of the internet, a wide area network, a satellite network, and a cellular network.

12. A crane comprising:

a) a crane body;

b) a crane boom attached to the crane body;

c) a plurality of outrigger assemblies attached to the crane body, each of the plurality of outrigger assemblies comprising:

i) an outrigger body coupled to the crane body;

ii) an outrigger jack coupled to the outrigger body and configured to selectively extend and retract relative to the outrigger body;

iii) an outrigger pad coupled to the outrigger jack; and iv) a sensor adapted to measure a reaction force on the outrigger pad caused by an interaction between the outrigger pad and a base surface; and d) a crane control system communicatively coupled to each of the sensors comprising:

i) a processor; and ii) a non-transitory computer readable storage memory having instructions stored thereon, that, when executed by the processor, cause the crane control system to perform a plurality of functions comprising:

A) compute a theoretical reaction force for each outrigger pad;

B) receive from a sensor a signal representing the measured reaction force at each outrigger pad;

C) compare the theoretical reaction force for each outrigger pad to the measured reaction force at each outrigger pad; and D) determine the stability of the crane based on the comparison of the theoretical reaction forces and the measured reaction forces.

13. The system of claim 12 wherein computing a theoretical reaction force for each outrigger pad comprises:

a) determining a position of the crane boom;

b) determining a position of each of the outrigger pads;

c) determining a crane load on the crane boom;

d) computing a center of mass for the crane and crane load; and e) computing the theoretical reaction force for each outrigger pad based on the center of mass and the position of each of the outrigger pads.

14. The crane of claim 12 wherein the crane control system is communicatively coupled to at least one of the sensors through a wireless connection.

15. A crane comprising:

a) a crane body;

b) a crane boom attached to the crane body;

c) a plurality of outrigger assemblies attached to the crane body, each of the plurality of outrigger assemblies comprising:

i) an outrigger body coupled to the crane body;

ii) an outrigger jack coupled to the outrigger body and configured to selectively extend and retract relative to the outrigger body;

iii) an outrigger pad coupled to the outrigger jack; and iv) a sensor adapted to measure reaction force on the outrigger pad caused by an interaction between a base surface and the outrigger pad; and d) a crane control system communicatively coupled to each of the sensors comprising:

i) a processor; and ii) a non-transitory computer readable storage memory having instructions stored thereon, that, when executed by the processor, cause the crane control system to perform a plurality of functions comprising:

A) receive from the sensor a signal representative of the reaction force at each outrigger pad;

B) determine a position of each of the outrigger pads;

C) compute a first center of mass based on the measured reaction force and position of each outrigger pad;

D) determine a position of the crane boom;

E) determine a crane load on the crane boom;

F) compute a second center of mass based on the position of the crane boom and the crane load;

G) compare the first center of mass to the second center of mass; and

H) determine the stability of the crane based on the comparison of the first center of mass to the second center of mass.

16. The crane of claim 15 wherein determining the stability of the crane comprises verifying the operation of a crane safety system.

17. The crane of claim 15 wherein determining the stability of the crane comprises determining a side-load of the crane boom.

18. The crane of claim 15 wherein the crane control system is communicatively coupled to at least one of the sensors through a wireless connection.

19. The crane of claim 15 further comprising a display operably coupled to the processor, wherein the plurality of functions further include a function for causing the processor to output a signal to the display for displaying a graphical representation of the first center of mass.

20. The crane of claim 15 further comprising a display operably coupled to the processor, wherein the plurality of functions further include a function for causing the processor to output a signal to the display for displaying a graphical representation of the reaction force of at least one outrigger pad.

21. The crane of claim 19 wherein the function for causing the processor to output a signal to the display for displaying a graphical representation of the first center of mass further comprises rotating the graphical representation of the first center of mass in response to a rotation of the crane boom.

22. The crane of claim 20 further comprising a display operably coupled to the processor, wherein the graphical representation of the reaction force of at least one outrigger pad comprises a sorted list of a plurality of graphical representations of a reaction force at a plurality of outrigger pads.

23. A crane outrigger pad strain monitoring system comprising:

a) an outrigger pad configured for coupling to an outrigger jack;

b) a strain gauge adapted to determine a strain within the crane outrigger pad and output a strain signal representative of the strain, the strain dependent upon a reaction force between the outrigger pad and a base surface;

c) a data processer operably coupled to the strain gauge to receive the strain signal; and d) a sensor operably coupled to the data processor and adapted to interact with the outrigger jack to identify a position of the outrigger pad relative to a crane including the outrigger jack.

24. The crane outrigger pad strain monitoring system of claim 23 wherein the sensor detects a physical characteristic of the outrigger jack.

25. The crane outrigger pad strain monitoring system of claim 23 further comprising a radio frequency identifier tag coupled to the outrigger jack and storing data identifying the outrigger pad placement and wherein the sensor detects the radio frequency identifier tag.

26. The crane outrigger pad strain monitoring system of claim 23 further comprising an external power source operably coupled to the data processor, wherein the external power source comprises a solar panel.

* * * * *